US005230730A

United States Patent [19]

Speckmann et al.

[11] Patent Number: 5,230,730

[45] Date of Patent: Jul. 27, 1993

[54] PROCESS FOR MANUFACTURING STABLE, LOW VISCOSITY O/W ANTI-RUST EMULSIONS

[75] Inventors: Horst-Dieter Speckmann, Langenfeld; Gert-Lothar Striepling, Duesseldorf; Frank Wiechmann, Duesseldorf; Jüergen Geke, Duesseldorf, all of Fed. Rep. of Germany

[73] Assignee: Henkel Kommanditgesellschaft auf Aktien, Duesseldorf, Fed. Rep. of Germany

[21] Appl. No.: 839,753

[22] PCT Filed: Sep. 25, 1990

[86] PCT No.: PCT/EP90/01626

§ 371 Date: Apr. 6, 1992

§ 102(e) Date: Apr. 6, 1992

[87] PCT Pub. No.: WO91/05033

PCT Pub. Date: Apr. 18, 1991

[30] Foreign Application Priority Data

Oct. 4, 1989 [DE] Fed. Rep. of Germany ..... 3933137

[51] Int. Cl.[5] ..... C09D 5/08

[52] U.S. Cl. ..... 106/14.13; 106/14.41; 106/14.44; 252/56 R; 252/351; 252/356; 252/388; 252/396

[58] Field of Search ..... 106/14.13, 14.41, 14.44; 252/56 R, 351, 356, 388, 396

[56] References Cited

U.S. PATENT DOCUMENTS

| | | | |
|---|---|---|---|
| 4,444,802 | 4/1984 | Winters et al. | 106/14.13 |
| 4,444,803 | 4/1984 | Winters et al. | 106/14.13 |
| 4,820,344 | 4/1989 | Geke et al. | 106/14.13 |

*Primary Examiner*—Mark L. Bell

*Assistant Examiner*—Anthony J. Green

*Attorney, Agent, or Firm*—Ernest G. Szoke; Wayne C. Jaeschke; Norvell E. Wisdom, Jr.

[57] ABSTRACT

The invention relates to a process for preparing stable low-viscosity O/W rust-inhibiting emulsions, characterized in that a mixture having the following composition is employed for the formation of the emulsion:

a) from 10 to 60% by weight of an oil component;

b) from 1 to 10% by weight of an emulsifier component consisting of at least one addition product of from 2 to 20 moles of ethylene oxide to fatty alcohols having from 10 to 22 carbon atoms;

c) from 1 to 10% by weight of a corrosion inhibitor consisting of at least one carboxylic acid having the general formula (I):

$$R—COOH \quad (I),$$

wherein R represents a straight-chain or branched saturated or unsaturated alkyl moiety comprising from 6 to 22 carbon atoms or a moiety having the general formula (II):

(II)

wherein $R^1$ represents a saturated straight-chain or branched alkyl moiety comprising from 8 to 18 carbon atoms;

d) from 0 to 10% by weight of co-emulsifier component consisting of at least one fatty alcohol comprising from 12 to 22 carbon atoms; and e) water as the balance.

20 Claims, 2 Drawing Sheets

PROCESS FOR MANUFACTURING STABLE, LOW VISCOSITY O/W ANTI-RUST EMULSIONS

BACKGROUND OF THE INVENTION

1. Field of the Invention

This invention relates to a process for preparing O/W (oil-in-water) rust-inhibiting emulsions based on an oil component, water, at least one emulsifier component, and a corrosion inhibitor. Observing certain conditions in said process leads to especially stable and low viscosity O/W emulsions which ensure good protection from corrosion for metal surfaces made of iron or steel.

2. Statement of Related Art

Rust-inhibiting emulsions are employed for the temporary protection of metallic workpieces from atmospheric influences causing corrosion. Said emulsions substantially contain non-polar or polar oils, emulsifiers, corrosion inhibitors, and water. The effect provided thereby is due to an adsorption of inhibitor molecules on the metal surface and the formation of a protective film from emulsion components, which film acts as a diffusion barrier for the oxygen of the air and for water. Th. Förster et al. in Oberfläche-Surface 1989, No. 4, pp. 8–12, report on the mode of action and methods of investigation of rust inhibiting emulsions. Other commercially available systems are based on oil concentrates containing emulsifiers and corrosion inhibitors—but no water. This depends on the emulsifiers and corrosion inhibitors employed being oil soluble. For the preparation of O/W emulsions from such oil concentrates this further means that such systems must be self-emulsifying.

It has been known that oil-in-water emulsions which have been prepared and stabilized with non-ionic emulsifiers can undergo a phase inversion when heated, i.e., at elevated temperatures the outer aqueous phase may become the inner phase. This process, as a rule, is reversible, i.e., upon cooling the initial emulsion type is regenerated. It has also been known that the point of phase inversion temperature is dependent on many factors, e.g., on the kind and phase volume of an oil component, on the hydrophilicity and structure of the emulsifier, and on the composition of the emulsifier system; cf., for example, K. Shinoda and H. Kunieda in *Encyclopedia of Emulsion Technology*, Vol. I, ed. P. Becher (M. Decker, N.Y., 1983), pp. 337 to 367. It has further been known that emulsions prepared at or slightly below the phase inversion temperature (PIT) are distinguished by particularly fine particle size and particular stability, whereas those emulsions prepared above the phase inversion temperature are less finely divided; cf. S. Friberg, C. Solans, J. Colloid Interface Sci., 66, pp. 367 to 368 (1978). F. Schambil, F. Jost, and M. J. Schwuger, in Progress in Colloid & Polymer Science 73, (1987), pp. 37 to 47, report on the properties of cosmetic emulsions containing fatty alcohols and fatty alcohol polyglycolethers and, in the course thereof, also describe how emulsions produced above the phase inversion temperature exhibit a low viscosity and a high storage stability. In the so far unpublished German Patent Application P 38 19 193.8 by Applicants there has been described a corresponding process for the preparation of stable low-viscosity O/W emulsions of polar oil components.

DESCRIPTION OF THE INVENTION OBJECT OF THE INVENTION

In contrast thereto it is the object of the invention to develop a process suitable for preparing O/W rust inhibiting emulsions which entirely or predominantly contain polar carboxylic acids as corrosion inhibitors. Such O/W emulsions should be capable of inverting at temperatures below 100° C. in order thereby to produce particularly stable finely divided and low viscosity emulsions. The emulsions thus obtained should further be water dilutable, and the dilutions should also be stable and provide an efficient protection from corrosion.

SUMMARY OF THE INVENTION

Accordingly, the invention relates to a process for preparing stable low-viscosity O/W rust inhibiting emulsions, wherein a mixture containing an oil component, water and at least one emulsifier component is emulsified at a temperature where all components of the mixture are in the liquid state, and the emulsion formed is heated at a temperature within or above the temperature range of phase inversion; or the mixture is emulsified at a temperature within or above the temperature range of phase inversion, followed by cooling the resulting emulsion to a temperature below said temperature range, and optionally by dilution with water, said process being characterized in that a mixture having the following composition is employed for the formation of the emulsion:

a) from 10 to 60% by weight of an oil component, b) from 1 to 10% by weight of an emulsifier component consisting of at least one addition product of from 2 to 20 moles of ethylene oxide to fatty alcohols having from 10 to 22 carbon atoms, c) from to 10% by weight of a corrosion inhibitor consisting of at least one carboxylic acid having the general formula (I):

$$R—COOH \qquad (I)$$

wherein R represents a straight-chain or branched saturated or unsaturated alkyl moiety comprising from 6 to 22 carbon atoms, or a moiety having the general formula (II):

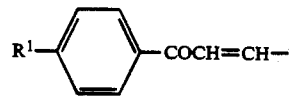

(II)

wherein $R^1$ represents a saturated or branched alkyl moiety comprising from 8 to 18 carbon atoms, d) from 0 to 10% by weight of co-emulsifier component consisting of at least one fatty alcohol comprising from 12 to 22 carbon atoms, and e) water as the balance.

Within the scope of the invention, the following items are of essential importance:

On the one hand, the selection of suitable carboxylic acids which in their acidic forms are effective as corrosion inhibitors and, on the other hand, the manner of preparing stable low viscosity O/W emulsions containing said corrosion inhibitors. Here, the carboxylic acids must not impair, or prohibit altogether, a phase inversion of the emulsion. Furthermore, the selection of suitable emulsifiers, which, on the one hand, will form such stable emulsions with said corrosion inhibitors and, on the other hand, will not impair the activity of the corrosion inhibitors on the substrate surface under atmospheric corrosion conditions by re-emulsification, is essential.

Surprisingly, the process according to the invention makes it possible to produce such stable and low viscosity O/W rust-inhibiting emulsions. In said process, the mixture comprising all of the emulsion components as set forth, including the carboxylic acids, is subjected to a phase inversion by heating the mixture or the emulsion already existing at a temperature within or above the temperature range of phase inversion. Thereby it is made possible to introduce said corrosion inhibitors in the finely divided form as desired into the emulsion and to stably emulsify them therein.

Within those of the above-defined composition of O/W rust inhibiting emulsions according to the invention which contain relatively high amounts of carboxylic acids as corrosion inhibitors, a phase inversion will take place below 100° C. This phase inversion takes place with non-polar oils (paraffin oils) as well as with lightly polar oils (mineral oils). These rust-inhibiting emulsions produced in accordance with so-called PIT method, i.e., phase inversion temperature method, have a higher storage stability when compared to emulsions having the same compositions but which have not undergone a phase inversion. Moreover, in the corrosion test, evaluated according to DIN 51 359, more than 40 days have passed until a 100% corrosion is observed. Thus, the anti corrosive effectiveness is in the same order of magnitude as that of the products belonging to prior art.

DESCRIPTION OF PREFERRED EMBODIMENTS

Figure 1A:
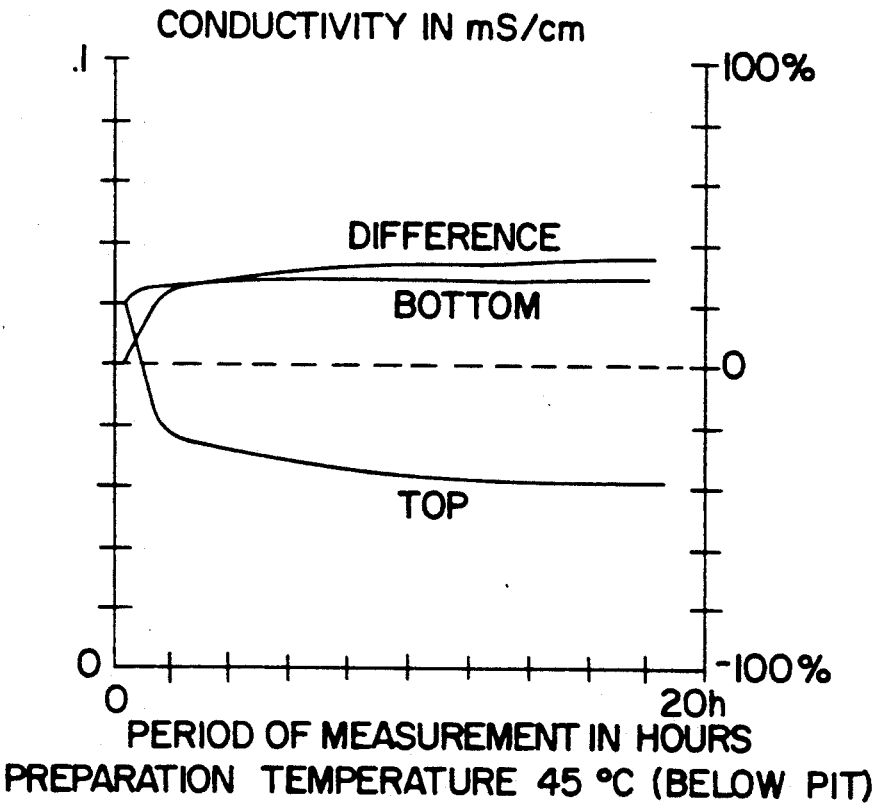
FIG. 1 depicts the variation, as a function of the time of storage, of the electrical conductance in the top and bottom regions of one emulsion according to the invention and one comparison example.

Within the scope of the invention it is preferred to employ, for forming the emulsion, a mixture having a composition as follows:

a) from 20 to 50% by weight of an oil component,
b) from 2 to 8% by weight of an emulsifier component,
c) from 2 to 6% by weight of a corrosion inhibitor,
d) from 0 to 6% by weight of a co-emulsifier component, and
e) water as the balance.

For the individual components of the O/W rust inhibiting emulsions to be prepared according to the invention, the following details apply:

As the oil component there may be employed oils of various polarities, for example paraffin oils or mineral oils. Also so-called ester oils, i.e., fatty acid glycerides, may be used in admixture with mineral oils and/or paraffin oils. Within the scope of the invention, it is preferred to employ paraffin oils or mineral oils as the oil component a).

The emulsifier component b) may include products from addition of from 2 to 20 moles of ethylene oxide to fatty alcohols comprising from 10 to 22 carbon atoms. Fatty alcohols suitable therefore are natural and/or synthetic fatty alcohols such as decanol, undecanol, dodecanol, tridecanol, tetradecanol, pentadecanol, hexadecanol (cetyl alcohol), heptadecanol, octadecanol (stearyl alcohol), nonadecanol, eicosanol, heneicosanol, and docosanol (behenyl alcohol). Commercially produced addition products of ethylene oxide to such fatty alcohols are usually mixtures of polyglycolethers of the initial fatty alcohols, the average ethoxylation degree of which conforms to the molar amount of ethylene oxide attached. Within the scope of the invention, addition products of from 4 to 12 moles of ethylene oxide to fatty alcohols having from 12 to 18 carbon atoms are preferred as the emulsifier component b). Especially used here are: Addition products of 4 moles of ethylene oxide to mixtures of fatty alcohols comprising from 12 to 14 carbon atoms, addition products of 4 moles of ethylene oxide to mixtures of fatty alcohols comprising from 12 to 18 carbon atoms, or addition products of 12 moles of ethylene oxide to mixtures of fatty alcohols comprising from 16 to 18 carbon atoms.

The carboxylic acids having the general formula (I)

$$R—COOH \quad (I)$$

employed as the corrosion inhibitors c) may be of different structures.

Within the meaning of the invention, suitable carboxylic acids of the general formula (I) are those wherein the radical R represents a straight-chain or branched, saturated or unsaturated alkyl moiety comprising from 6 to 22 carbon atoms. These include, more specifically, natural or synthetic fatty acids, for example hexanoic acid (caproic acid), heptanoic acid, octanoic acid (caprylic acid), nonanonic acid, decanoic acid (capric acid), undecanoic acid, dodecanoic acid (lauric acid), tridecanoic acid, tetradecanoic acid (myristic acid), pentadecanoic acid, hexadecanoic acid (palmitic acid), heptadecanoic acid, octadecanoic acid (stearic acid), nonadecanoic acid, arachidic acid, heneicosanoic acid and behenic acid. In the same manner, the corresponding branched-chain or unsaturated carboxylic acids are suitable as corrosion inhibitors within the scope of the invention. According to the invention, those carboxylic acids of the general formula (I), wherein the moiety R represents a straight-chain or branched saturated or unsaturated alkyl moiety having from 8 to 18 carbon atoms are preferred. The corresponding straight-chain saturated fatty acids are apparent from the above listing. As the branched chain or unsaturated carboxylic acids of this type there are especially considered isononaoic acid, oleic acid, linoleic acid, or linolenic acid. Mixtures of said acids are also effective corrosion inhibitors within the scope of the present invention, for example, a mixture comprising stearic acid and palmitic acid in a ratio by weight of 1:1.

The corrosion inhibitors within the scope of the invention further include carboxylic acids having the general formula (I) wherein R represents a moiety having the general formula (II)

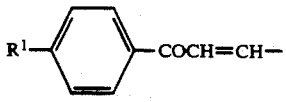

(II)

wherein $R^1$ represents a saturated straight-chain or branched alkyl moiety comprising from 8 to 18 carbon atoms. Such alkylbenzoylacrylic acids and the use thereof as corrosion inhibitors in lubricating oils and lubricating greases have been described in the DE-OS 36 00 401. In said German Laid-Open Patent Application there are also found indications relating to the synthesis of such alkylbenzoylacrylic acid. Thus, the alkyl radicals $R^1$ may be unbranched or branched radicals from the group of octyl, nonyl, decyl, undecyl, dodecyl, tridecyl, tetradecyl, pentadecyl, hexadecyl, heptadecyl, and octadecyl, with the corresponding straight-chain alkyl radicals having from 8 to 12 carbon atoms being preferred according to the invention. According to the invention, among this type of carboxylic acids the 3-(p-dodecylbenzoyl) acrylic acid is employed with particular advantage.

It has further proven to be advantageous for the process according to the invention to employ a co-emulsifier component (d) in addition to the emulsifier component. The co-emulsifier, due to its hydrophilicity, itself is not suitable for preparing O/W emulsions; however, especially stable and finely divided emulsions of polar oil components can be prepared in combination with the above-defined emulsifier components according to the invention. The coemulsifiers according to the invention may include saturated fatty alcohols having from 12 to 22 carbon atoms. The fatty alcohols suitable for this purpose have been mentioned in the above enumeration of fatty alcohols. Also suitable are mixtures of such fatty alcohols as obtained, for example, upon the technical hydrogenation of vegetable and animal fatty acids having from 12 to 22 carbon atoms or of the corresponding fatty acid methyl esters. It is preferred within the scope of the invention that such coemulsifiers be employed in amounts of from 1 to 6% by weight, based on the mixture. Particularly preferred as co-emulsifiers are fatty alcohols comprising 16 to 18 carbon atoms, for example a mixture of cetyl alcohol and stearyl alcohol in a ratio by weight of 1:1.

According to a further preferred embodiment of the present invention, the oil component a), the emulsifier component b), and the corrosion inhibitor c) are employed in a definite ratio by weight of a):b):c)+1:(0.1 to 0.3):(0.1 to 0.3). Thus, especially low-viscosity and storage-stable rust-inhibiting emulsions are obtained. A ratio by weight of a:b:c=1:0.2:0 15 is particularly preferred.

The process according to the invention may be carried out in a manner such that first the phase inversion temperature is determined by heating the sample of the emulsion prepared in the usual manner by using an apparatus for measuring the conductivity and determining the temperature at which the conductivity strongly decreases. The specific conductivity of the oil-in-water emulsion as initially present will commonly drop within a temperature interval of from 2° C. to 8° C. from initially more than 1 mS/cm to values of below 0.1 mS/cm upon transition into an inverted emulsion. This temperature range is denoted as the phase inversion temperature range.

After the phase inversion temperature range for a definite composition of an emulsion is known, the process according to the invention may, in one mode, be carried out by first preparing the emulsion as usual so that it contains all of the components essential for the invention and then heating the emulsion thus obtained at a temperature within or above the phase inversion temperature range. Another mode of carrying out the process according to the invention comprises preparing a pre-determined emulsion at a temperature already pre-selected such as to be within or above the phase inversion temperature range. As a rule, the last-mentioned mode is practiced, i.e., all of the components essential according to the invention for a definite emulsion are mixed, the resulting mixture is heated at some temperature above the phase inversion temperature range, and the mixture is then emulsified by vigorous stirring. The emulsion formed is then allowed to cool to a temperature below the phase inversion temperature range, or the emulsion is cooled to an appropriate temperature. Thereby, concentrates of O/W rust-inhibiting emulsions, which may optionally be diluted with water, are obtained.

The O/W rust-inhibiting emulsions may be put into use in the form of the concentrates as well as in the form of the water dilutions obtained from said concentrates. However, usually they are used in the diluted form. The concentrates as well as the water-diluted emulsions ensure a very good protection from corrosion to be provided for metal surfaces from iron and steel. The anti-corrosive activity of the emulsions produced according to the invention is also retained, if the carboxylic acids effective as corrosion inhibitors are present in their neutralized forms. With a view thereto, it is possible to subsequently neutralize the O/W rust inhibiting emulsions prepared according to the invention with suitable alkaline agents, for example with caustic solutions such as NaOH or $Ca(OH)_2$ solutions.

Figure 2:
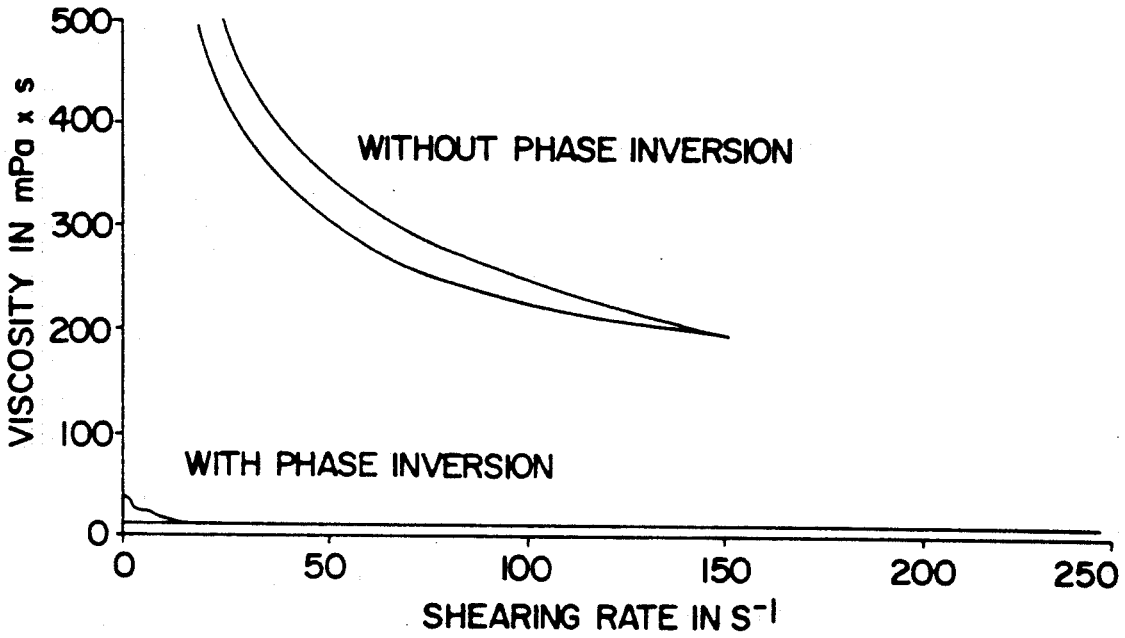
FIG. 2 depicts the variation, as a function of shear rate, of the viscosities of one emulsion according to the invention and one comparison example.
Figure 3:
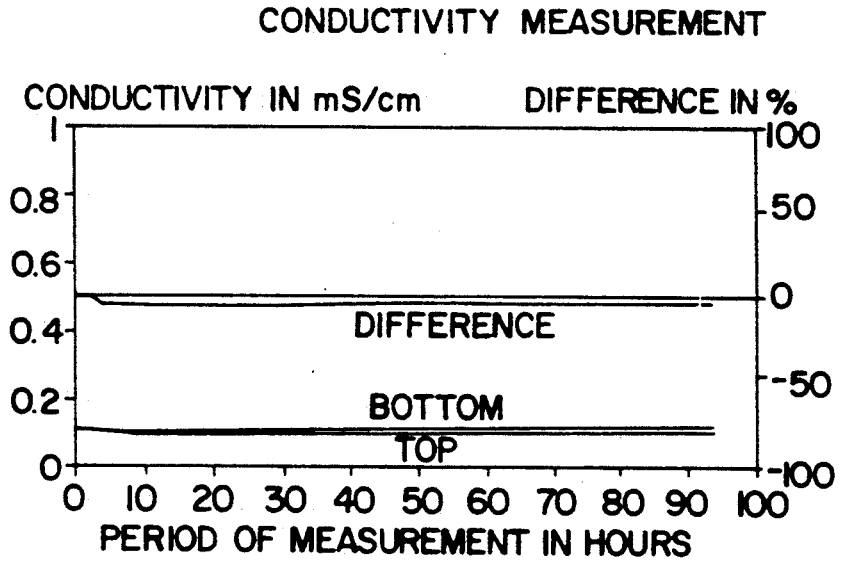
FIG. 3 depicts the variation, as a function of the time of storage, of the electrical conductance in the top and bottom regions of another emulsion according to the invention.

The oil-in-water rust-inhibiting emulsions prepared upon temperature inversion by the process according to the invention, in comparison to emulsions prepared below the phase inversion temperature, are particularly finely divided and have low viscosities and, hence, are pourable and pumpable (FIG. 2). Moreover, said rust inhibiting emulsions also exhibit a marked storage stability. Upon comparison of the periods of time passed until test sheets show 100% corrosion (evaluated according to DIN 51 359), the sheets treated with anti-corrosive emulsions according to the invention showed a lower susceptibility to corrosion than did the sheets treated with conventional anti-corrosive emulsions. Upon phase inversion, concentrates of rust-inhibiting emulsions could be obtained which contain more than 50% of organic matter. These concentrates, because they, after the preparation thereof, constitute oil-in-water systems and because the oil phase is present in the most finely dispersed state, are readily water-dilutable without thereupon losing their high storage stabilities (FIG. 3). In contrast to the conventional systems based on oil-concentrates, for carrying out the process according to the invention, the emulsifier mixtures and corrosion inhibitors need not necessarily be oil-soluble.

The process according to the invention and the advantages provided by the O/W rust-inhibiting emulsions produced thereby are illustrated in greater detail by the following Examples.

EXAMPLES

The formulations described below were prepared using various commercial products, the compositions and sources of which were as follows:

| | |
|---|---|
| Mineral oil Pionier ® 4556 | Mineral oil (naphthene-based) from Hansen & Rosenthal, Hamburg |
| Emulgin ® B1: | Product of addition of about 12 moles of ethylene oxide to cetylstearyl alcohol (a mixture consisting of cetyl and stearyl alcohols in a weight ratio of about 1:1), from Henkel KGaA, Düsseldorf |
| Lanette ® O: | Cetylstearyl alcohol (a mixture consisting of cetyl and stearyl alcohols in a weight ratio of about 1:1), from Henkel KGaA, Düsseldorf |
| Dehydol ® LS4: | Product of addition of about 4 moles of ethylene oxide to $C_{12-14}$ fatty alcohols, from Henkel KGaA, Düsseldorf |
| Dehydol ® LT4: | Product of addition of about 4 moles of ethylene oxide to $C_{12-18}$ fatty alcohols, from Henkel KGaA, Düsseldorf |

Compositions of the Formulations A to D

Formulation A:
40% by weight of mineral oil Pionier ® 4556
8% by weight of Emulgin ® B1
6% by weight of 1:1 stearic acid/palmitic acid
46% by weight of water
Formulation B:
20% by weight of paraffin oil
5% by weight of Dehydol ® LS4
3% by weight of 3-(p-dodecylbenzoyl)acrylic acid
2% by weight of Lanette ® O
70% by weight of water
Formulation C:
20 % by weight of mineral oil Pionier ® 4556
3 % by weight of Emulgin ® B1
1 % by weight of Dehydol ® LT4
3 % by weight of 1:1 stearic acid/palmitic acid
73 % by weight of water
Formulation D:
20 % by weight of mineral oil Pionier ® 4556
4 % by weight of Emulgin ® B1
3 % by weight of lauric acid
73 % by weight of water

EXAMPLE 1

Preparation of the O/W Rust-Inhibiting Emulsions According to the Invention, Based on the Formulations A to D:

The individual components as indicated for each of the formulations A to D were mixed, and each mixture was emulsified by vigorous stirring at a temperature above the respective phase inversion temperature range. The relevant data are shown in the following Table 1.

TABLE 1

| Example | Formulation | Phase Inversion Temperature Range | Emulsifying Temperature |
|---|---|---|---|
| 1.1 | A | 62 to 64° C. | 70° C. |
| 1.2 | B | 60 to 75° C. | 80° C. |
| 1.3 | C | 67 to 89° C. | 95° C. |
| 1.4 | D | 62 to 71° C. | 95° C. |

EXAMPLE 2

Figure 1B:
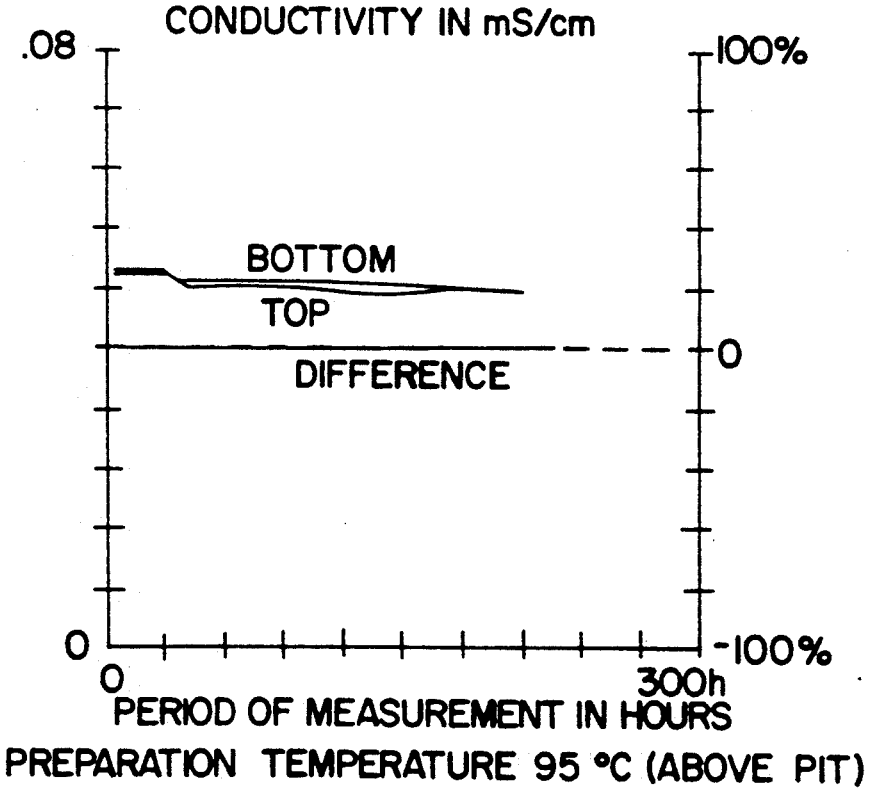

Comparison of the Stability of Emulsions Having the Same Compositions, but Different Preparations Temperatures (FIG. 1).

Two emulsions were prepared from mixtures of Formulation D. For the first emulsion, a preparation temperature of 45° C.—below the phase inversion temperature (PIT) range—was chosen, while for the second emulsion a preparation temperature of 95° C.—above the PIT—was chosen, in the same manner as in Example 1.4. For evaluating the stability of each emulsion, the conductivity thereof was measured in the upper and lower regions of the measuring vessel (cf. the left scale of FIG. 1), and the percentage difference was calculated (cf. the right scale of FIG. 1). The measuring vessel was a glass cylinder (height: 125 mm; diameter: 25 mm), in which two pairs of platinum electrodes (Type PP 1042 from Radiometer) were provided in each of the positions 2 mm from the top and 2 mm from the bottom. For the measurement, the glass vessel was completely filled with each emulsion under investigation, which contained 50 mg of NaCl per 1 liter of emulsion as the supporting electrolyte, so that even the electrodes in the top region of the vessel were completely immersed in the solution. All of the measurements were carried out at room temperature.

In the case of an unstable emulsion there is a creaming tendency—in the sense of separation of the emulsion within the course of the period of measurement—shown by different conductivities in the top and bottom regions of the measurement vessel; the percentage difference is not zero. However, in the case of stable emulsion, there are nearly no differences between the conductivities in the different measurement regions; accordingly the percentage difference is zero or close to zero.

FIG. 1 shows the results obtained by the measurement. It is apparent that the first emulsion, with a preparation temperature of 45° C. (below PIT), was already unstable within a period of measurement of 20 hours, whereas the second emulsion, prepared according to the invention at a temperature of 95° C. (above PIT) was stable over a substantially longer period of time.

EXAMPLE 3

Comparison of the Viscosity of Emulsions Having the Same Compositions, but Different Preparation Temperatures (FIG. 2).

Two emulsions were prepared from mixtures of Formulation A. For the first emulsion, a preparation temperature of 60° C.—below PIT—was chosen, while for the second emulsion according to this invention a preparation temperature of 95° C.—above the PIT—was chosen, in the same manner as in Example 1.1. The resulting emulsions were diluted with water in a ratio of 1:1, and the viscosities of the diluted emulsions were determined at various shearing rates.

FIG. 2 shows the results of the measurements, which represent the viscosity behavior of a diluted emulsion, i.e., a preferred embodiment. It is evident therefrom that the second emulsion according to the invention (with phase inversion) was substantially less viscous than the first emulsion (without phase inversion).

EXAMPLE 4

Storage Stability of Emulsion According to the Invention

The storage stability at room temperature of the emulsions according to Examples 1.1 to 1.3 was visually assessed. In these tests, the emulsions were employed in the form of their concentrates; the emulsions according to Examples 1.1 and 1.3 were tested as prepared, unchanged, while the emulsion according to Example 1.2 was neutralized with $Ca(OH)_2$ prior to the test. The results are shown in Table 2.

TABLE 2

| Emulsion According to Example: | Storage Stability at Room Temperature |
|---|---|
| 1.1 | >6 months |
| 1.2 | >1 month |
| 1.3 | >6 months |

The results show that the concentrates according to the invention have a very good storage stability.

EXAMPLE 5

Storage Stability of a Diluted Emulsion According to the Invention (FIG. 3)

An emulsion according to Example 1.1 was diluted and neutralized with aqueous NaOH solution in a ratio of 1:9. For the evaluation of the stability of the resulting emulsion, the conductivities in the top and bottom regions of the measuring vessel were determined (cf. the left scale of FIG. 3), and the percentage difference was calculated (cf. the right scale of FIG. 3). The significance of this measurement procedure with respect to the stability of the emulsion is explained in greater detail in Example 2.

FIG. 3 shows the results obtained by the measurement. Therefrom it will be apparent that even the diluted emulsion, i.e., in its preferred embodiment, was stable for a period of nearly 100 hours. This period is absolutely sufficient for the stability of a water diluted emulsion, i.e., that form in which the emulsions are usually applied, in comparison to the concentrate form, i.e., that form in which the emulsions are usually stored.

EXAMPLE 6

Test of the Anti-Corrosive Ability

The anti-corrosive property of emulsions according to the invention and of a comparative emulsion was tested according to DIN 51 359. The test procedure was carried out as follows: Steel sheets of the grade St 1405 (unalloyed steel, surface-refined, dimensions 2.5 cm x 5 cm) were each immersed in one of the rust-inhibiting emulsions as indicated below. The steel sheets were kept in contact for a short time with the rust-inhibiting emulsions, then removed therefrom and, after a dripping and drying period of 24 hours, were placed in a moist chamber as specified in DIN 51 359, wherein the relative humidity was 100%, with a continuous air supply of 875 l/h at a temperature of 50 ° C. In each case there was determined a period of time after which a 100% corrosion (relative to the area of the test sheet) was to be observed - evaluated according to DIN 51 359.

The emulsions employed in the test were as follows:

| | |
|---|---|
| Example 6.1: | Emulsion according to Example 1.1, undiluted and in various dilutions with water cf. Table 3). |
| Example 6.2: | Emulsion according to Example 1.2, neutralized with $Ca(OH)_2$, undiluted and in various dilutions with water (cf. Table 3). |
| Example 6.3: | Emulsion according to Example 1.3. |
| Example 6.4: | Emulsion according to Example 1.4. |
| Comparative Example: | An emulsion was prepared based on formulation D, with the emulsifying temperature being 45° C. (non-inverted emulsion). The resulting emulsion was neutralized with diethanolamine. |

The test results are set forth in Table 3.

TABLE 3

| Example | Dilutions with Water | 100% Corrosion After: |
|---|---|---|
| 6.1 | 1:1; 1:3; 1:7; 1:9 | 40 days |
| 6.2 | 1:1; 1:4 | 40 days |
| 6.3 | — | 40 days |
| 6.4 | — | 26 days |
| Comparison | — | 13 days |

In the Examples 6.1 and 6.2 the period of time as indicated above was reached with each of the undiluted emulsion and all of the dilutions tested.

What is claimed is:

1. A process for preparing stable low-viscosity O/W rust-inhibiting emulsions, said process comprising steps of:

(I) providing a mixture consisting essentially of:

(a) from 10 to 60% by weight of an oil component;

(b) from 1 to 10% by weight of an emulsifier component consisting of at least one addition product of from 2 to 20 moles of ethylene oxide to fatty alcohols having from 10 to 22 carbon atoms;

(c) from 1 to 10% by weight of a corrosion inhibitor consisting of at least one carboxylic acid having the general formula (I)

$$R—COOH \quad (I),$$

wherein R represents a straight-chain or branched saturated or unsaturated alkyl moiety comprising from 6 to 22 carbon atoms or a moiety having the general formula (II):

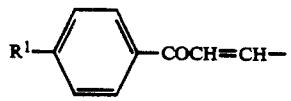

(II)

wherein $R^1$ represents a saturated straight-chain or branched alkyl moiety comprising from 8 to 18 carbon atoms,; and (d) up to 10% by weight of co-emulsifier component consisting of t least one fatty alcohol comprising from 12 to 22 carbon atoms, and (e) water as the balance;

(II) a step selected from the group consisting of:

(A) emulsifying the mixture provided in step (I) at a temperature where all components of the mixture are in the liquid state but which is below the temperature range of phase inversion of the mixture, and subsequently heating the emulsion so formed to a temperature within or above the temperature range of phase inversion of the mixture; and (B) emulsifying the mixture provided in step (I) at a temperature within or above the temperature range of phase inversion of the mixture; and (III) cooling the resulting emulsion after completion of step (II) to a temperature below the phase inversions temperature range of the mixture; and, optionally, (IV) diluting with water the emulsion formed at the end of step (III).

2. The process according to claim 1, wherein the mixture provided in step (I) has a composition as follows:

(a) from 20 to 50% by weight of the oil component;

(b) from 2 to 8% by weight of the emulsifier component;

(c) from 2 to 6% by weight of the corrosion inhibitor;

(d) not more than 6% by weight of the co-emulsifier component; and (e) water as the balance.

3. The process according to claim 2, wherein the mixture provided in step (I) contains from 1 to 6% by weight of the co-emulsifier component (d).

4. The process according to claim 3, wherein a paraffin oil, a mineral oil, or both a paraffin and a mineral oil are employed as the oil component (a).

5. The process according to claim 3, wherein at least one addition product of from 4 to 12 moles of ethylene oxide to fatty alcohols having from 12 to 18 carbon atoms is employed as the emulsifier component (b).

6. The process according to claim 3, wherein, as the corrosion inhibitor (c), there is employed at least one carboxylic acid having the general formula (I), wherein R is a straight-chain or branched, saturated or unsaturated alkyl moiety having from 8 to 18 carbon atoms or a moiety having the general formula (II) wherein $R^1$ is a saturated straight chain alkyl moiety having from 8 to 12 carbon atoms.

7. The process according to claim 3, wherein at least one fatty alcohol having from 16 to 18 carbon atoms is employed as the co-emulsifier component (d).

8. The process according to claim 7, wherein the components (a), (b), and (c) are employed in a ratio by weight of (a):(b):(c)=, 1:0.2:0.15.

9. The process according to claim 1, wherein a paraffin oil, a mineral oil, or both a paraffin and a mineral oil are employed as the oil component (a).

10. The process according to claim 1, wherein at least one addition product of from 4 to 12 moles of ethylene oxide to fatty alcohols having from 12 to 18 carbon atoms is employed as the emulsifier component (b).

11. The process according to claim 1, wherein, as the corrosion inhibitor (c), there is employed at least one carboxylic acid having the general formula (I), wherein R is a straight-chain or branched, saturated or unsaturated alkyl moiety having from 8 to 18 carbon atoms or a moiety having the general formula (II) wherein $R^1$ is a saturated straight chain alkyl moiety having from 8 to 12 carbon atoms.

12. The process according to claim 11, wherein the components (a) (b), and (c) are employed in a ratio by weight of (a):(b):(c)=1:(0.1 to 0.3):(0.1 to 0.3).

13. The process according to claim 10, wherein the components (a), (b), and (c) are employed in ratio by weight of (a):(b):(c)=1:(0.1 to 0.3):(0.1 to 0.3).

14. The process according to claim 9, wherein the components (a), (b), and (c) are employed in a ratio by weight of (a):(b):(c)=1:(0.1 to 0.3):(0.1 to 0.3).

15. The process according to claim 6, wherein the components (a), (b), and (c) are employed in a ratio by weight of (a):(b):(c)=1:0.2:0.15.

16. The process according to claim 5, wherein the components (a), (b), and (c) are employed in a ratio by weight of (a):(b):(c)=1:0.2:0.15.

17. The process according to claim 4, wherein the components (a), (b), and (c) are employed in a ratio by weight of (a):(b):(c)=1:0.2:0.15.

18. The process according to claim 3, wherein the components (), (b), and (c) are employed in a ratio by weight of (a):(b):(c)=1:(0.1 to 0.3):(0.1 to 0.3).

19. The process according to claim 2, wherein the components (a), (b), and (c) are employed in a ratio by weight of (a):(b):(c)=1:(0.1 to 0.3):(0.1 to 0.3).

20. The process according to claim 1, wherein the components (a), (b), and (c) are employed in a ratio by weight of (a):(b):(c)=1:(0.1 to 0.3):(0.1 to 0.3).

* * * * *